US005480327A

United States Patent [19]

Zola

[11] Patent Number: 5,480,327

[45] Date of Patent: Jan. 2, 1996

[54] ELECTRICAL CONNECTOR FOR CABLE

[75] Inventor: Thomas J. Zola, Harrisburg, Pa.

[73] Assignee: The Whitaker Corporation, Wilmington, Del.

[21] Appl. No.: 247,956

[22] Filed: May 24, 1994

[51] Int. Cl.[6] ..... H01R 13/648

[52] U.S. Cl. ..... 439/607; 439/736; 439/445

[58] Field of Search ..... 439/445, 447, 439/736, 638, 607–610, 733

[56] References Cited

U.S. PATENT DOCUMENTS

| | | | |
|---|---|---|---|
| 4,227,764 | 10/1980 | fiske | 439/638 |
| 4,484,792 | 11/1984 | Zengler et al. | 439/736 |
| 4,556,275 | 12/1985 | Hamsher, Jr. | 439/736 |
| 4,579,404 | 4/1986 | Lockard | 339/14 R |
| 4,602,831 | 7/1986 | Lockard | 339/14 R |
| 4,641,902 | 2/1987 | Fusselman | 339/91 R |
| 4,653,836 | 3/1987 | Peele | 339/143 R |
| 4,674,816 | 6/1987 | Frenzick et al. | 439/736 |
| 4,871,319 | 10/1989 | Babow | 439/77 |
| 4,941,848 | 7/1990 | Philippson et al. | 439/607 |
| 4,981,447 | 1/1991 | Ichitsubo | 439/607 |
| 5,116,245 | 5/1992 | Baker | 439/581 |
| 5,162,000 | 11/1992 | Frantz | 439/607 |
| 5,169,346 | 12/1992 | Johnston | 439/676 |
| 5,171,161 | 12/1992 | Kachlic | 439/352 |
| 5,195,909 | 3/1993 | Huss, Jr. et al. | 439/465 |
| 5,199,903 | 4/1993 | Asick et al. | 439/610 |
| 5,203,717 | 4/1993 | Beck et al. | 439/460 |
| 5,203,717 | 4/1993 | Beck et al. | 439/460 |
| 5,211,578 | 5/1993 | Henschen et al. | 439/494 |
| 5,236,375 | 8/1993 | Kachlic | 439/607 |
| 5,295,859 | 3/1994 | Kawai | 439/447 |

*Primary Examiner*—David L. Pirlot

[57] ABSTRACT

A cable connector (1) comprises, an insulative overmold (10) surrounding a section of a round electrical cable (5) transformed into a thin, wide section (16), with multiple wires (4) of the cable (5) being grouped together, side by side, within said section (16), an insulating housing insert (2) mounting electrical contacts (3) connected to respective wires (4) of the cable (5), and conductive shielding (6) encircling the housing insert (2) and the overmold (10), said shielding (6) being connected to a conductive shield (9) of the cable (5) at a window (20) through the overmold (10).

20 Claims, 3 Drawing Sheets

ELECTRICAL CONNECTOR FOR CABLE

FIELD OF THE INVENTION

The invention relates to an thin electrical connector for cable containing multiple wires, and more particularly, to a thin electrical connector that is thinner than a diameter of a cable.

BACKGROUND OF THE INVENTION

An information storage device known as a PCMCIA card is adapted to plug into a slot of a reader device that will input and extract magnetically coded information stored by the card. A reader device may have multiple slots for accepting different cards plugged into the slots. The cards are thin, and allow the slots to be close together in a compact reader device.

The edge of a PCMCIA card will also connect with an electrical cable that is used to input and extract information stored by the card. An electrical connector is needed for the multiple wires of the cable. One such connector is disclosed in U.S. patent application, Ser. No. 08/158,127, filed Nov. 24, 1993 (15573). The cable and the connector were required to be thin and wide to allow plugging onto one of various cards that are close together.

Heretofore, a thin, wide cable comprised, multiple wires grouped together, side by side, in a thin, but wide, plane that matched the thinness of the electrical connector. The thin, wide cable was suited for connection to cards that were close together. However, the wide dimension of the cable resisting bending in the plane of thickness. Accordingly, the cable could be used solely in applications that avoided bends in the plane of thickness of the cable.

SUMMARY OF THE INVENTION

A round cable is a circumferentially round cable in which multiple wires are grouped together, side by side. A round cable is more flexible than a thin, wide cable. A round cable is more susceptible to bending in every direction than is a thin, wide cable. An advantage of the invention resides in a thin electrical connector that plugs into a narrow space, and is adapted for connection to a round cable, rather than a thin, wide cable.

A round cable needs to fit into a narrow space that is thinner or more narrow than the cable. The invention adapts the cable to fit into the space. Accordingly, an advantage of the invention resides in a thin connector that adapts a round cable to fit into a space that is thinner than the cable.

An embodiment in which the advantages reside transforms a round section of the cable into a thin, wide section that is thinner than the diameter of the cable, while preserving the bend flexibility in the round cable that joins the thin, wide section.

An embodiment of the invention will now be described with reference to the accompanying drawings, according to which;

DETAILED DESCRIPTION

Figure 1:
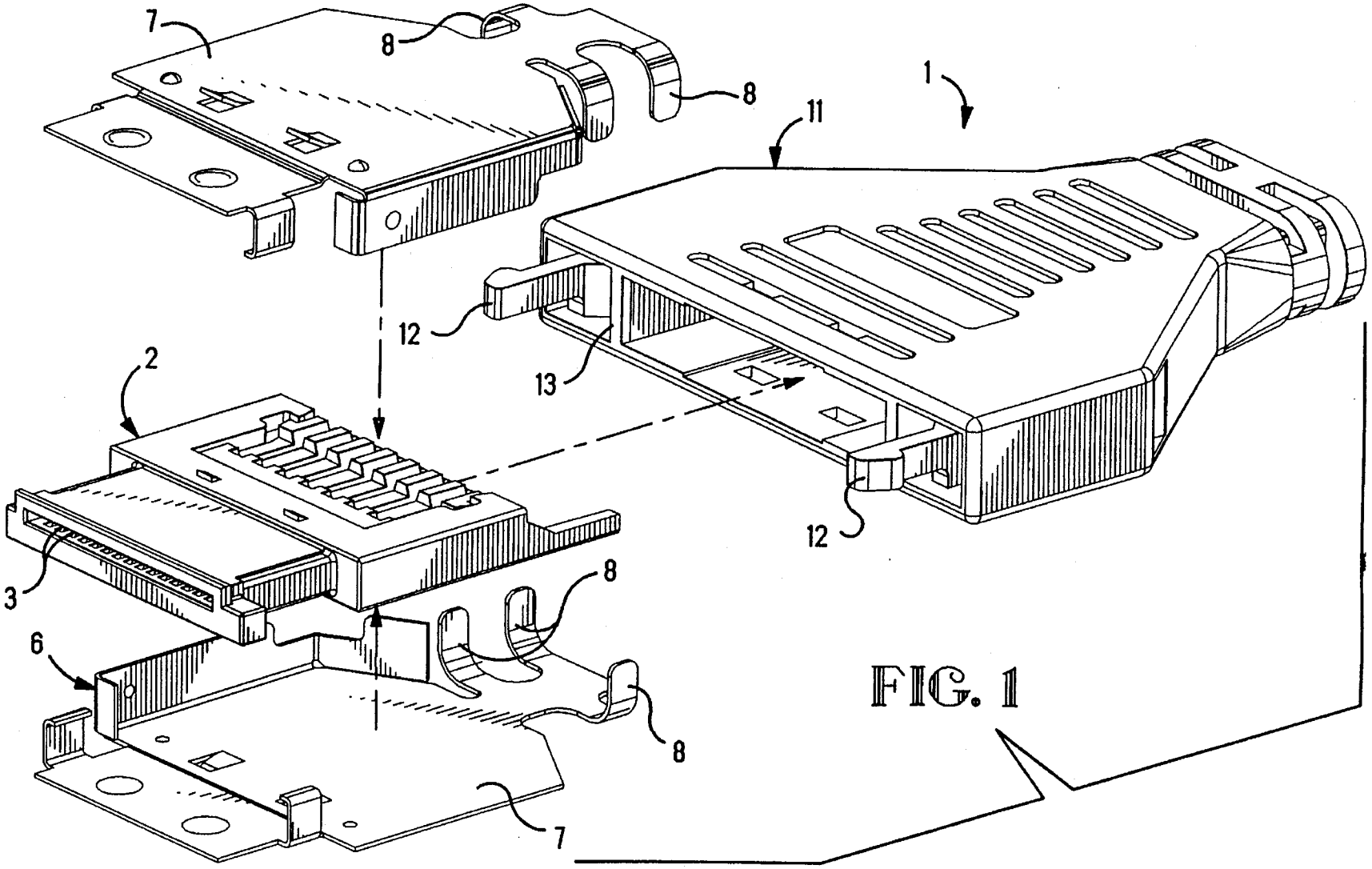
FIG. 1 is a perspective view of an electrical connector with parts separated from one another.
Figure 2:
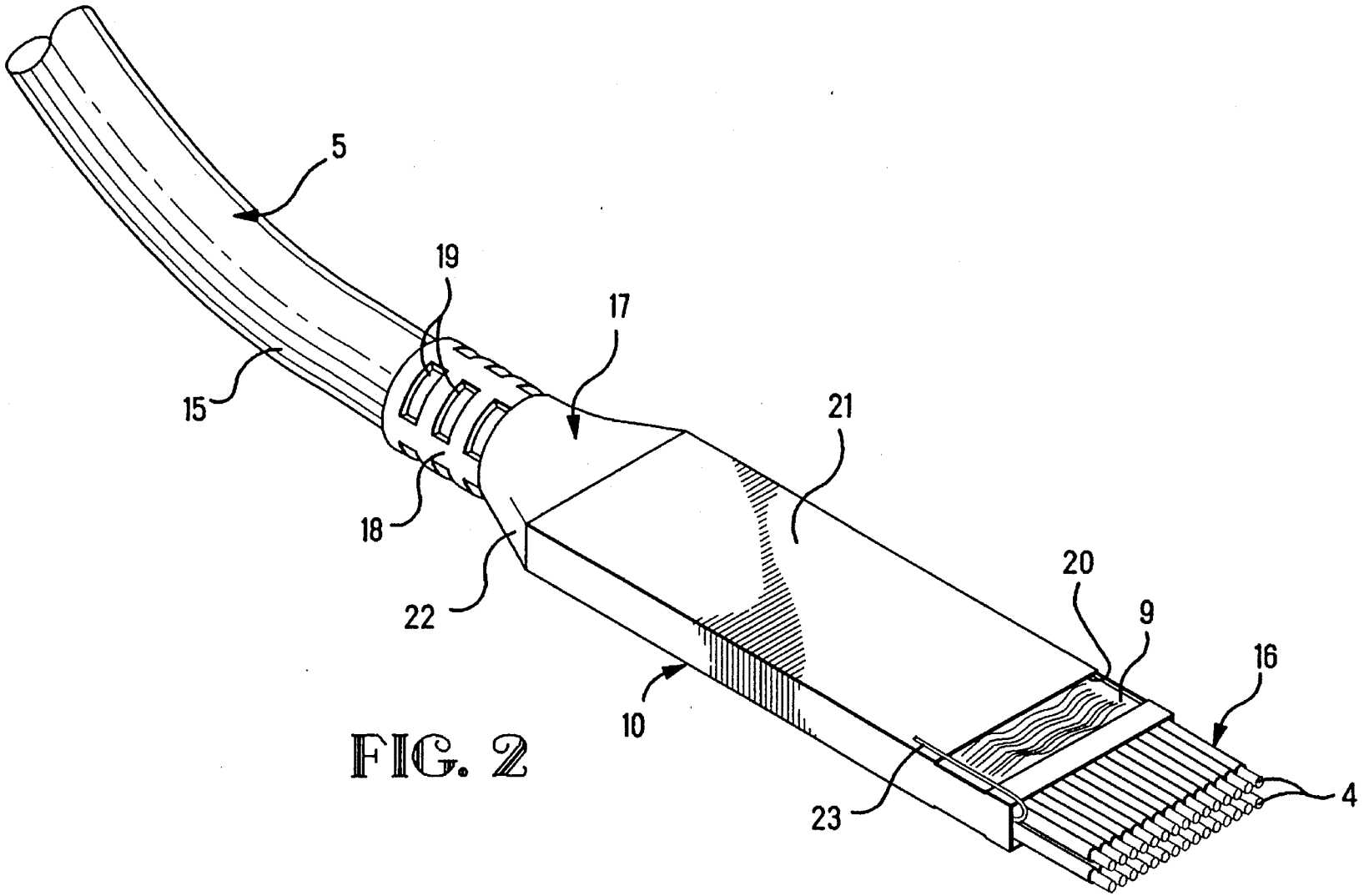
FIG. 2 is a perspective view of a portion of an electrical cable and an insulative overmold on the cable.

With reference to FIG. 1, an embodiment of a cable connector 1 comprises, an insulating housing insert 2 on which are mounted electrical contacts 3 to be connected to respective, multiple wires 4 of an electrical cable 5, FIG. 2, for example, by a soldering process; conductive shielding 6 comprising, two metal shielding members 7 with crimping ears 8 for crimping about the cable 5 to connect electrically with a conductive shield 9 of the cable 5; an insulative overmold 10 surrounding the cable 5; and the conductive shielding 6 being adapted for encircling the overmold 10.

With reference to FIG. 2, the wires 4 are insulation covered and project forwardly from a remainder of the cable 5. Bare conductive portions of the wires are adapted for connection to respective contacts 3, for example, by a soldering process. After the wires 4 are connected to the contacts 3, the shielding 6 encircles the housing insert 2 and portions of the wires 4 connected to the contacts 3, and is crimped to the conductive shield 9 of the cable 5. An insulating, dielectric cover member 11 receives and encircles the shielding 6 and the cable 5. Locking arms 12 project from a mating face 13 of the cover member 11. Further details of the cover member 11, as well as other parts of the connector 1, are disclosed in the U.S. Patent application referred to previously.

With reference to FIG. 2, a round outer cable jacket 15 covers the shield 9 of the cable 5. The shield 9 covers and encircles all of the insulated wires 4. Within the round cable jacket 16 the wires are arranged parallel to each other. A front portion of the jacket 16 is cut away and removed, to project the shield 9 forwardly of the jacket 16. A front portion of the shield 9 is cut away and removed to project the wires 4 forwardly of the shield 9. The wires 4 are arranged in two rows of parallel wires 4 where they project forwardly from the exposed shield 9. The cable 5 becomes thin and wide, where the wires 4 are arranged in the two rows. Thereby, the round cable 5 becomes transformed into a thin and wide, section 16.

Reference will now be made to FIG. 2. For the cable 5 to fit into a narrow space, not shown, the connector 1 adapts the electrical cable 5 with the overmold 10 encircling the thin and wide section 16 of the cable 5 for fitting into the narrow space. An advantage of the thin and wide section 16 resides in adapting the cable 5 to fit into a space that is thinner, or narrower, than the round part of the cable 5. Within the thin and wide section 16, the multiple wires 4 of the cable 5 are grouped together, side by side. The wires 4 are parallel, and are spaced apart. For example, the wires 4 are spaced apart on a pitch spacing corresponding to the pitch spacing of the contacts 3 mounted on the housing insert 2. The thin and wide section 16 further comprises another, diverging section of the cable, referred to as a transition section 17 of the cable 5. The transition section 17 of the cable 5 is partially flattened, as compared to the width or diameter of the cable 5, and is progressively, or increasingly, wider, as compared to the width or diameter of the cable 5. Through the transition section 17, the multiple wires 4 of the cable 5 diverge from one another, and are spread out divergingly until they are spaced apart from one another. Then the spaced apart wires 4 extend forwardly from the transition section 17. Additionally, the wires extend parallel and spaced apart along the thin and wide section 16. The wires 4 extend forwardly along said transition section 17 of the cable 5 and said thin and wide section 16.

Further, according to known practices, the overmold 10 is applied in fluent form and is solidified to provide a unitary component or part that imbeds the wires 4 to position and hold them in place within the thin and wide section 16, including the transition section 17. The overmold 10 further imbeds the shield 9 of the cable 5 and the jacket 15 of the cable. Accordingly, the connector 1 comprises, a length of transition along which the multiple wires 4 of the round cable 5 are spread apart from one another into a thin and wide section 17 of the cable 5 that is held in place by a part of the connector 1, for example, the overmold 10 in this embodiment. The overmold 10 is of unitary construction, and further comprises, a cylindrical, strain relief 18 that extends over a portion of the remainder of the cable 5. A series of slots 19 through the strain relief 17 widen or narrow in response to bending of the cable 5.

With reference to FIG. 2, a window 20 through each opposite side of the overmold 10 is formed during formation of the overmold 10. Each window 20 exposes the shield 9 of the cable 5, which shield 9 is first exposed when the jacket 15 of the cable 5 has been cut away, as previously described. Also exposed at the window 20 are the wires 4 that are side by side defining a thickness and width of the cable 5 that is encircled and gripped by the crimping ears 8 of the shielding 6. The crimping ears 8 extend into the window 19, and are connected to the shield 9 of the cable 5 at the window 19.

Figure 3B:
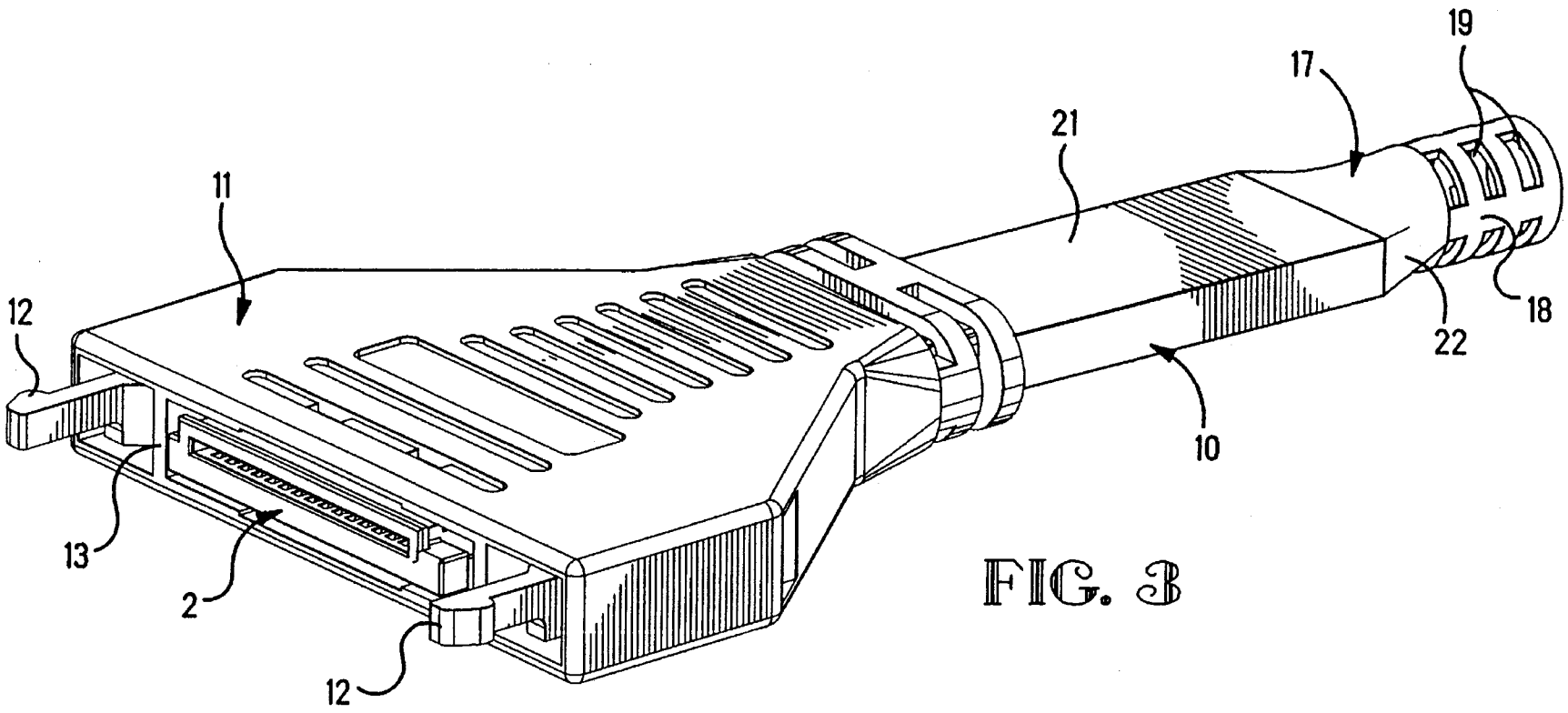
FIG. 3 is a perspective view of the connector shown in FIG. 1 assembled on the cable shown in FIG. 2.

As shown in FIG. 2, a thin and wide section 21 of the overmold 10 covers the thin and wide section 16 of the cable, including a partially flattened and wider section 22 of the overmold 10 covering the transition section 17 of the cable 5. As shown in FIG. 3, both a rear portion of the thin and wide section 16 of the cable 5, and the encircling overmold section 21, project and extend rearward from the shielding 6 and the cover member 11. This feature, comprising, an extended, lengthy section 16 of the cable 5 and accompanying overmold section 21, spaces a remainder of the round cable 5 rearwardly of a narrow space, not shown, into which the connector 1 fits, and into which the thin and wide section 16 fits, which narrow space can be thinner than the thickness or diameter of the remainder of the cable 5. The round portion of the cable 5 is adapted to bend with equal flexibility in all directions, while the cable 5 forwardly of the strain relief 18 remains unbent and fitting along the narrow space.

In addition, the feature of a lengthy, thin and wide section 16 of the cable, and an accompanying overmold section 21, permits the overmold 10 to pass through the cover member 11 prior to assembly of the remaining parts of the connector 1 with the cable 5. The cover member 11 is assembled to encircle the overmold section 21. The cover member 11 is slid rearwardly along the overmold section 21 of the overmold 10, until each window 19, and a front of the overmold 10 and the wires 4 project beyond the mating face 13 of the cover member 11 for assembly to the insert 2 and the shield members 7 of the shielding 6. After such assembly, the cover member 11 is slid forwardly along the overmold section 21 to encircle the shielding 6.

The cable 5 might further comprise, an uninsulated drain wire 23 extending forwardly together with the insulated wires 4 of the cable 5. The connector 1 is adapted to connect the shielding 6 to the drain wire 23, by bending the drain wire 23 back on itself to overlap the window 20 prior to assembly of the shielding 6 over the window 20 and the overlapping drain wire 23. The drain wire 23 projects forwardly from the overmold 10, and is bent back on itself to engage and be covered by the conductive shielding 6.

Other embodiments and modifications of the invention are intended to be covered according to the spirit and scope of the appended claims.

I claim:

1. A cable connector comprising: an insulating housing insert mounting electrical contacts connected to respective wires of an electrical cable, conductive shielding encircling the housing insert and being connected to a conductive shield of the cable, an insulative overmold surrounding a section of a round electrical cable transformed into a thin and wide section in which multiple wires of the cable are grouped together, side by side, within said section, and the conductive shielding encircling the overmold.

2. A cable connector as recited in claim 1, comprising: an insulating boot covering the conductive shielding.

3. A cable connector as recited in claim 1, comprising: the overmold encircling a partially flattened and increasingly wider section of the cable through which the wires extend and diverge from one another, the wires extending from said partially flattened and increasingly wider section of the cable toward said thin and wide section.

4. A cable connector as recited in claim 3, comprising: an dielectric cover member covering the conductive shielding.

5. A cable connector as recited in claim 1, comprising: the conductive shielding being connected to a conductive shield of the cable at a window through the overmold.

6. A cable connector as recited in claim 5, comprising: an dielectric cover member covering the conductive shielding.

7. A cable connector as recited in claim 1, comprising: the wires projecting forwardly from the overmold and being connected to respective contacts.

8. A cable connector as recited in claim 1, comprising: the wires being parallel and spaced apart within said thin and wide section.

9. A cable connector as recited in claim 1, comprising: a drain wire of the cable projecting forwardly from the overmold and being bent back on itself to engage and be covered by the conductive shielding.

10. A cable connector as recited in claim 9, comprising: an dielectric cover member covering the conductive shielding.

11. A cable connector comprising: an insulative overmold surrounding a section of a round electrical cable transformed into a thin, wide section with multiple wires of the cable being grouped together, side by side, within said section, an insulating housing insert mounting electrical contacts connected to respective wires of the cable, and conductive shielding encircling the housing insert and the overmold, said shielding being connected to a conductive shield of the cable at a window through the overmold.

12. A cable connector comprising: a housing insert mounting electrical contacts connected to respective wires of an electrical cable, conductive shielding over the insert and connected to shielding of the cable, the wires of the cable being routed from a round section of the cable and through a partially flattened and increasingly wider section of the cable and through a thin and wide section, an insulative overmold surrounding both said sections, said shielding receiving the housing insert and the overmold.

13. A cable connector as recited in claim 12, comprising: an insulating boot covering the conductive shielding.

14. A cable connector as recited in claim 12, comprising: the overmold encircling a partially flattened and increasingly wider section of the cable through which the wires extend and diverge from one another, the wires extending from said partially flattened and increasingly wider section of the cable toward said thin and wide section.

15. A cable connector as recited in claim 14, comprising: an dielectric cover member covering the conductive shielding.

16. A cable connector as recited in claim 12, comprising: the conductive shielding being connected to a conductive shield of the cable at a window through the overmold.

17. A cable connector as recited in claim 16, comprising: an dielectric cover member covering the conductive shielding.

18. A cable connector as recited in claim 12, comprising: the wires projecting forwardly from the overmold and being connected to respective contacts.

19. A cable connector as recited in claim 12, comprising: the wires being parallel and spaced apart within said thin and wide section.

20. A cable connector as recited in claim 12, comprising: a drain wire of the cable projecting forwardly from the overmold and being bent back on itself to engage and be covered by the conductive shielding.

* * * * *